10/15/85 OR 4,547,284

United States Patent [19]

Sze et al.

[11] Patent Number: 4,547,284

[45] Date of Patent: Oct. 15, 1985

[54] COKE PRODUCTION

[75] Inventors: Morgan C. Sze, Upper Montclair; Thomas M. Bennett, Scotch Plains; Andre A. Simone, Parsippany, all of N.J.; Dennis F. Ogren, Sao Paulo,, Brazil; Mikio Nakaniwa, Ome; Kenji Furukawa, Tokyo, both of Japan

[73] Assignees: Lummus Crest, Inc., Bloomfield, N.J.; Maruzen Petrochemical Co., Ltd., Tokyo, Japan

[21] Appl. No.: 640,228

[22] Filed: Aug. 13, 1984

Related U.S. Application Data

[63] Continuation of Ser. No. 348,921, Feb. 16, 1982, abandoned, which is a continuation-in-part of Ser. No. 214,378, Dec. 5, 1980, abandoned.

[51] Int. Cl.[4] ..... C10G 9/14

[52] U.S. Cl. ..... 208/50; 208/131

[58] Field of Search ..... 208/50, 131, 108

[56] References Cited

U.S. PATENT DOCUMENTS

| | | | |
|---|---|---|---|
| 2,775,549 | 12/1956 | Shea, Jr. | 208/131 |
| 3,472,761 | 10/1969 | Cameron | 208/131 |
| 3,547,804 | 12/1970 | Noguchi et al. | 208/131 X |
| 3,673,080 | 6/1972 | Schlinger et al. | 208/131 |
| 3,769,200 | 10/1973 | Folkins | 208/50 X |
| 3,930,985 | 1/1976 | Schieber et al. | 208/131 X |
| 3,936,358 | 2/1976 | Little | 208/131 X |
| 3,959,115 | 5/1976 | Hayashi et al. | 208/50 |
| 3,960,704 | 6/1976 | Kegler et al. | 208/131 X |
| 4,049,538 | 9/1977 | Hayashi et al. | 208/50 |
| 4,108,798 | 8/1978 | Sze et al. | 208/50 X |
| 4,199,434 | 4/1980 | Sze et al. | 208/131 X |

FOREIGN PATENT DOCUMENTS 7411601 10/1970 Japan .

*Primary Examiner*—D. E. Gantz
*Assistant Examiner*—Glenn A. Caldarola
*Attorney, Agent, or Firm*—Elliot M. Olstein

[57] ABSTRACT

In the delayed coking of a coking feedstock wherein the feedstock is continuously heated in a coking heater and introduced into a coke drum, the heater is operated to provide a coke drum temperature of from 415° to 455° C., and, after filling of the drum to the desired level, feedstock introduction is discontinued and the coke drum contents are heated at a temperature of 450° C. to 500° C., and which heating temperature is at least 10° C. greater than the coking temperature, by passing a non-coking vapor through the contents of the drum to reduce the volatile combustible matter content to a value of 4% to 10% by weight and thereby reduce the CTE of the formed coke. The process is applicable to the production of needle coke from various kinds of feedstocks, in particular from a petroleum feedstock wherein the feedstock is initially treated by thermal soaking in the presence of sulfur, followed by thermal cracking to increase the aromaticity. Noncrystalline substances may be removed prior to coking to further improve the process.

25 Claims, 1 Drawing Figure

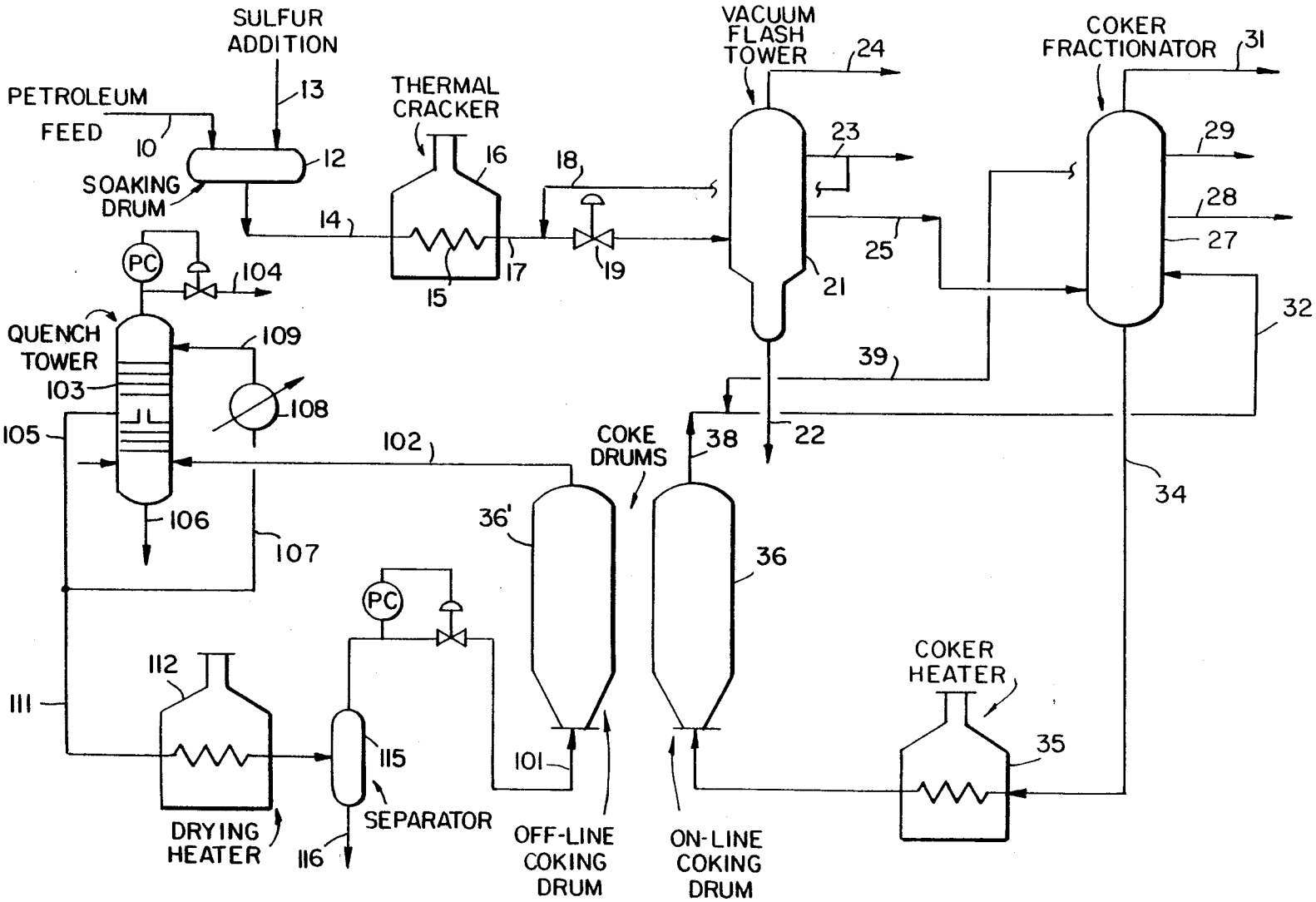
COKER FRACTIONATOR
VACUUM FLASH TOWER
THERMAL CRACKER
SULFUR ADDITION
PETROLEUM FEED
SOAKING DRUM
QUENCH TOWER
COKE DRUMS
COKER HEATER
ON-LINE COKING DRUM
OFF-LINE COKING DRUM
SEPARATOR
DRYING HEATER
PC
PC
10
12
13
14
15
16
17
18
19
21
22
23
24
25
27
28
29
31
32
34
35
36
36'
38
39
101
102
103
104
105
106
107
108
109
111
112
115
116

COKE PRODUCTION

This application is a continuation of U.S. application Ser. No. 06/348,921, filed Feb. 2, 1982, now abandoned, which in turn is a continuation-in-part of U.S. application Ser. No. 214,378 filed on Dec. 5, 1980 abandoned.

This invention relates to a process for producing coke, and more particularly to a process for producing needle coke.

It is known in the art to produce coke from a wide variety of feedstocks by a delayed coking procedure. Such procedures have been directed to the production of both anode grade coke, and to a premium quality coke, often referred to as needle coke.

U.S. Pat. No. 4,108,798 describes an improved process for producing a needle coke (a highly crystalline petroleum coke) wherein the petroleum feedstock is initially heat soaked in the presence of sulfur, followed by controlled thermal cracking and separation of non-crystalline substances from the cracked feedstock. The thus treated feedstock is then subjected to delayed coking to produce highly crystalline petroleum coke.

The present invention is directed to the production of coke by a delayed coking procedure.

In accordance with the present invention, a coking feedstock is subjected to delayed coking at coking temperatures lower than those normally employed in the art.

After the coke drum has been filled to a desired level, introduction of feedstock is discontinued, as normally practised in the art, and, in accordance with the invention, the contents of the drum are heated at a temperature which is higher than the temperature employed during the coking step or stage, to remove volatile combustible matter therefrom, and thereby produce a coke having a reduced coefficient of thermal expansion (CTE). Although the present invention has applicability to a wide variety of delayed coking procedures for producing coke, the present invention has particular applicability to the production of a needle coke and most particularly a high quality crystalline coke from a feedstock which has been pretreated by thermal soaking, and/or cracking and/or removing of non-crystalline substances. For example, a process employing all three steps is desired in U.S. Pat. No. 4,108,798.

More particularly, in accordance with the general teachings of the present invention, delayed coking is accomplished by the general procedure known in the art wherein coking feedstock is continuously heated in a coking heater and introduced into a coke drum until the contents reaches a desired fill level, followed by taking the coke drum off-stream for removal of coke, except that in accordance with the present invention, the coke drum is operated at lower temperatures of from 415° C. to 455° C., preferably of from 420° C. to 450° C., and after the coke drum is taken off-stream; i.e., the coking feedstock is no longer introduced into the coke drum, the contents of the off-stream coke drum are heated at a temperature which is at least 10° C. greater than the coking temperature (preferably at least 15° C. and most preferably at least 20° C. greater than the coking temperature) and which temperature is at least 450° C., preferably at least 460° C. and no greater than 500° C., preferably no greater than 480° C. (preferably by passing a heated non-coking vapor through the contents of the drum) for a time to produce a coke having a volatile combustible matter content of at least 4%, preferably at least 5%, and no greater than 10%, preferably no greater than 8%, all by weight. The time required for producing the coke with such volatile combustible matter content after taking the drum "off-stream" will vary with the coke produced, the feedstock employed for producing such coke and the heating temperature; however, in most cases such reduction can be accomplished by "off-stream" heating for a time period in the order of from four hours to 24 hours.

The subsequent off-stream heating of the contents of the coke drum is accomplished by the use of a non-coking vapor. Any one of a wide variety of materials which are not suitable for the production of coke may be employed for such heating and as representative examples of suitable materials, there may be mentioned liquid coker distillate, coker gases ($C_1$–$C_4$ hydrocarbons), stream, nitrogen and other non-coking gases except gases which are oxidizing gases. The selection of a suitable gas for accomplishing the heating is deemed to be within the scope of those skilled in the art from the teachings herein. It is to be understood that in some cases it may be possible to accomplish such heating by means other than passing a heated gas through the coke drum contents; however, for most commercial operations, the preferred and most practical manner of heating the coke drum contents is by use of superheated vapors.

It is to be understood that in some cases the heating of the coke drum contents may be accomplished with a material, which is capable of forming coke, such as heated coker recycle or coker recycle plus relatively low concentrations of coker feedstock; however, in most cases the quality of the coke produced by the use of such materials is lower than the quality produced by the use of a non-coking material.

Thus, in accordance with the present invention, the delayed coking is conducted at a temperature lower than normally used in the art until the coke drum is filled to the desired level, and after taking the drum off-stream the contents thereof are heated at a higher temperature to effect a reduction in the volatile combustible matter content thereof. The combination produces a final product which when calcined has a reduced CTE. The specific temperature employed in each of the coking step and subsequent off-stream heating will vary with the particular feedstock as well as the desired CTE for the final product. In general, it has been found that the use of lower temperatures within the hereinabove described general range of coking temperatures produces a final product with a lower CTE; however, with some feeds higher temperatures within the hereinabove described general range of coking temperatures are required to achieve a suitable rate of reaction.

As hereinabove noted, the present invention is particularly applicable to the production of a highly crystalline coke (needle coke), and most particularly to the production of a highly crystalline coke from a feedstock which has been pretreated in accordance with the teachings of U.S. Pat. No. 4,108,798 or U.S. Pat. No. 4,199,434.

In accordance with the overall process of the present invention, the feedstock is initially heat-soaked in the presence of sulfur, followed by heating the heat-soaked feedstock to a higher temperature to effect controlled thermal cracking thereof, which enhances the aromaticity of the feedstock. The material from the thermal cracking then treated to separate non-crystalline substances therefrom, follwed by heating of the coking feedstock, free of non-crystalline substances, in a coking heater to provide coke drum temperatures in the order of from 415° C. to 455° C., and after filling of the coke drum, which is taken off stream, the contents there of are heated at a temperature which is at least 10° C. greater than the coking temperature and which temperature is from 450° C. to 500° C., for a time sufficient to reduce the volatile combustible matter content thereof to a value as hereinabove described.

The feedstocks which are generally employed for the production of coke in accordance with the invention are heavy feedstocks, such as a distillation residue derived from a crude oil, lube oil extract and hydrodesulfurized lube extract, a cracking residue or a hydrodesulfurized product of a residue from the distillation or cracking of petroleum. Preferred feedstocks are the so-called pyrolysis fuel oils or black oils which are the residual heavy black oils boiling above pyrolysis gasoline; i.e., boiling above 187° C. to 218° C. which are produced together with olefins in the pyrolysis of liquid hydrocarbon feeds, catalytic cracker decant oils, thermally cracked tar, lube oil extract and its hydrodesulfurization product, coal tar or pitch distillates and the like. In general, such feedstocks have low sulfur content; i.e., sulfur content of 1.5 wt.% or less, preferably of 0.8 wt.% or less. Blends of such feeds may be employed.

The feedstock is initially soaked in the presence of at least 30 parts per million of sulfur, with such sulfur preferably being provided by adding sulfur (generally in the form of at least one member selected from the group consisting of elemental sulfur, mercaptan and carbon disulfide). In most cases, the added sulfur does not exceed 200 ppm. The soaking is generally effected for at least 5 minutes, and most generally from 5 to 120 minutes. The soaking temperature is generally in the order of from 230° to 315° C. It is to be understood that if the requisite sulfur is present in the feed, sulfur need not be added thereto. In some cases, it may be possible to achieve the desired results by soaking at a temperature of from 230° to 315° C. without the use of sulfur. It is believed that the soaking step improves the overall operation by polymerizing polymerizable components.

The soaked feedstock is then heat treated to effect controlled thermal cracking thereof and to thereby increase the aromaticity (reduce API gravity). The heat treatment to effect cracking, which follows the initial thermal soaking, is performed by heating the feedstock, generally in a tubular heater, under a pressure in the order of from 4 to 50 kg/cm$^2$G to an outlet temperature in the order of from 450° to 595° C. The cracking is effected for a period of time to increase the aromaticity, with such cracking generally being in the order of from 15 to 20 seconds. In general, the API gravity is decreased by at least 1° (based on the material boiling above 260° C.).

Subsequent to the heat treating, the feedstock may be processed to remove non-crystalline substances, and non-distillable heavy components, with such separation generally being easily accomplished by the use of high temperature flashing, with such flashing generally being at a temperature of 380° to 510° C. under a pressure of from 0.1 kg/cm$^2$(A) to 2 kg/cm$^2$G. In the flashing, the non-crystalline substances can be selectively removed as a pitch bottoms. The material recovered as the coking feedstock generally boils within the range of from 260° C. to 538° C. Lighter components from the feedstock, such as gas, gasoline and gas oil may be separately recovered.

The coking feedstock, which has been pretreated, as hereinabove described, is then subjected to delayed coking by the general procedure known in the art, except that in accordance with the present invention, it has been found that the coking temperature should be controlled to temperatures lower than those generally used in the art. The optimum coking temperature varies with each feedstock. The coking pressure is generally in the order of from 2 to 10 kg/cm$^2$ G.

Subsequent to filling of the coke drum, the drum is taken off-stream and the contents heated at a temperature which is at least 10° C. greater than the coking temperature and which temperature is from 450° C. to 500° C. for a time sufficient to reduce the volatile combustible matter content to the values as hereinabove described.

Although the hereinabove described embodiment is particularly preferred, it is to be understood that one or more of the steps for pretreating the feed may be eliminated, with the coking procedure of the present invention, in such cases, also providing an improvement in the coke quality, although in most cases the combination of the three pretreating steps, in combination with the controlled coking heater outlet temperatures and subsequent off-stream heating to reduce the volatile combustible matter content producing the highest quality coke. Thus, for example, the initial soaking may be eliminated, and/or the cracking of the feedstock may be eliminated and/or the separation of non-crystalline components may be eliminated within the spirit and scope of the present invention, provided that the coking heater is operated at the hereinabove described temperatures and the contents thereof heat treated off-stream as hereinabove described, to produce a coke having the hereinabove described volatility.

U.S. Pat. No. 4,199,434, for example, discloses pretreating a coking feedstock by the combination of soaking at a first temperature in the presence of sulfur, followed by heating at a higher temperature to reduce API gravity. U.S. Pat. No. 3,687,840 discloses pretreating a coking feed in the presence of sulfur.

The invention will be further described with respect to an embodiment thereof illustrated in the accompanying drawing wherein:

The drawing is a simplified schematic representation of a flow diagram for effecting the process of the present invention.

Referring now to the drawing, a feed, in line 10, is introduced into a soaking drum, schematically generally indicated as 12, with sulfur, if required, being introduced into the drum 12 through line 13. In drum 12, the feed is thermally soaked, as hereinabove described, with such soaking effecting polymerization of highly unsaturated compounds.

The soaked feedstock is withdrawn from drum 12 through line 14 and introduced into a coil 15 in a thermal cracking heater 16 wherein the feed is subjected to thermal cracking conditions, as hereinabove described, in order to increase the overall aromaticity thereof (reduce API gravity). The cracked feedstock is withdrawn from coil 15 in line 17, quenched with a light gas oil, obtained as hereinabove described, in line 18, and the combined stream passed through a pressure reduction valve 19 into a vacuum flash tower, schematically generally indicated as 21. The vacuum flash tower is operated at temperatures and pressures to separate from the feed non-crystalline substances and other heavy components. In general, the flash tower is operated at a temperature in the order of from 380° to 510° C., and at a pressure in the order of from 0.1 kg/cm²A to 2 kg/cm²G.

A heavy pitch-like bottoms is recovered from tower 21 through line 22. A light gas oil is recovered from tower 21 through line 23, with a portion thereof being employed in line 18 as a quench oil Naphtha and lighter gases are recovered from the flash tower through line 24.

The pretreated coking feedstock, which is recovered through line 25 is generally those components which are within a boiling temperature range in the order of from 268° to 538° C., and such components are introduced into a coker combination fractionator tower, schematically generally indicated as 27.

The coker combination fractionator tower 27 is operated, as known in the art, to recover the coking feedstock bottoms, and to also recover lighter components, which are generally not employed in the coking feedstock, such as a heavy coker gas oil in line 28, a light coker gas oil in line 29 and coker naphtha and gases in line 31. The coker combination fractionating tower 27, as shown in the art, is also provided with coke drum overhead vapors through line 32.

Bottoms withdrawn from the tower 27 through line 34 is passed through a coking heater, of a type known in the art, and schematically generally indicated as 35, and the heated material is introduced into a coke drum, schematically generally indicated as 36. The coke drum is operated at the temperatures and pressures hereinabove described. Overhead vapors are withdrawn from coke drum 36 through line 38, and after quenching by a portion of the light gas oil in line 39, such overhead vapors are introduced into the coker fractionator 27 through line 32.

After the coke drum is filled, as known in the art, the coke drum is taken "off-line;" i.e., the drum is no longer provided with coking feedstock. The off-line drum is indicated as 36' in the drawing.

In accordance with the present invention, the off-line drum 36' is heated to a higher temperature to reduce the volatile combustible matter content thereof and reduce the CTE. As shown in the drawing, superheated gas, such as light coker distillate, naphtha, coker gas, etc. is introduced into the coking drum 36' through line 101, with such gas generally being at a temperature and pressure sufficient to maintain the off-line drum 36' at the temperatures hereinabove described for reducing the volatile combustible matter content. In general, the vapor is introduced at a temperature in the order of from 450° to 525° C. and at a pressure in the order of from 2 to 10 kg/cm²G. The vapor introduced through line 101, as well as volatile matter driven off from the drum contents is withdrawn from off-line coke drum 36' through line 102, and introduced into a quench tower, schematically generally indicated as 103, designed and operated to recover the non-coking vapor to be employed in off-line drum 36'. In quench tower 103, lighter components are recovered through line 104, as a gas; the material to be used as the drying gas is recovered through line 105, as a liquid; and heavier components are recovered through line 106. A portion of the material in line 105 is passed through line 107, including a cooler 108 for introduction into tower 103 through line 109, as reflux. The remaining portion in line 111 is heated in heater 112 to effect vaporization thereof for use as a drying gas. The heated material from heater 112 is introduced into a separator 115 to separate unvaporized material which is withdrawn through line 116. Superheated vapor is withdrawn from separator 115 through line 101 for introduction into the "off-line" drum to provide a coke having a volatile combustible matter contents, as hereinabove described.

Although the invention has been described with respect to a particular embodiment, it is to be understood that the scope of the invention is not limited to such an embodiment. Thus, for example, the process may be effected by a processing scheme other than the one particularly described with respect to the drawing.

In one modification, the vapor for the drying step could be recovered from the coker combination tower and the material withdrawn from the off-line drum is returned to the coker combination tower. Thus, in such an operation, the coker combination tower is employed for both the "on-line" and "off-line" coke drums.

Similarly, although the preferred embodiment has been described with reference to pretreating the feed by (1) a low temperature soak to polymerize unsaturates; (2) thermal cracking to increase aromatic content (reduce API gravity); and (3) separation of pitch, the invention is also applicable to coke production without such pretreatment and to coke production which employs one or more of such pretreatment steps.

The above modifications and others should be apparent to those skilled in the art from the teachings herein.

The present invention will be further described with respect to the following example; however, the scope of the invention is not to be limited thereby:

EXAMPLE I

Decant oils having the properties summarized in Table 1 were added with 50 parts per million of sulfur and heat soaked at a temperature of 260° C. The feedstock so treated was introduced into a SUS tube of 6 mm inner diameter and thermally cracked at a temperature of 500° C. under a pressure of 20 kg/cm²G. (The residence time was 78 seconds on the cold oil basis). The feedstock was then introduced into a flash tower maintained at 480° C. under normal pressure and nonvolatile substances were removed from the bottom of the flash tower as pitch. The oil obtained by cooling the overhead effluent was used as the coking feedstock.

TABLE 1

| | |
|---|---|
| Specific gravity, 15°/4° C. | 1.0187 |
| API gravity | 7.4 |
| Asphaltenes ($C_7$ insolubles) | 1.6 wt % |
| Conradson carbon | 5.71 wt % |
| Sulfur content | 0.75 wt % |
| Ash | 0.01 wt % |

Delayed coking was carried out under the conditions shown in Table 2, using the oil obtained under the above-mentioned conditions. The coke drum which was about 30 cm in inner diameter and about 50 cm in height was placed in a molten salt bath and was so designed as to permit external heating. After the drum was filled, the drum was taken off-stream and heated, as tabulated.

TABLE 2

| | | Run No. | | | | |
|---|---|---|---|---|---|---|
| | | A | B | C | D | E |
| On-Stream Delayed Coking | Temp. (°C.) | 425 | 435 | 440 | 430 | 460 |
| | Press. (Kg/cm$^2$ G) | 5 | 5 | 5 | 5 | 5 |
| | Time (hr) | 24 | 24 | 24 | 24 | 24 |
| | Recycle Ratio | 1.0 | 1.0 | 1.0 | 1.0 | 1.0 |
| Off-Stream Heating | Temp. (°C.) | 460 | 460 | 480 | 430 | 480 |
| | Time (hr) | 7 | 7 | 4 | 7 | 4 |
| | Heated Vapor | Coker light gas oil External* | Coker light gas oil External* | Coker light gas oil External* | No External* | No External* |
| | Green Coke VCM (%) | 8.8 | 8.2 | 5.3 | 26.3 | 4.2 |

*External: The heating temperature was maintained by use of a molten salt bath without having recourse to heated vapor.

Runs A through C shown in Table 2 were performed by the process according to the present invention, while runs D through E were performed under different conditions: the off-stream temperature in run D was lower; and the on-stream coking temperature in run E was higher than those used in the process of this invention. Green coke obtained under these conditions was calcined at 1,400° C. by the ordinary method, and calcined coke was pulverized. Each sample of calcined coke was blended with coal tar pitch as a binder and the mix was extruded into rods to make electrodes. The electrodes were baked at 1,000° C. and graphitized at 3,000° C. The coefficient of thermal expansion (CTE) in the direction parallel to the extrusion was measured. The measurements obtained are shown in Table 3.

TABLE 3

| | A | B | C | D | E |
|---|---|---|---|---|---|
| CTE ($\times 10^{-6}$/°C.) in the direction parallel to the extrusion (100 to 400° C.) | 0.79 | 0.74 | 0.89 | 1.31 | 1.21 |

The green coke which was obtained in run D contained a lot of pitchy substance in the upper portion. It melted and foamed during calcining and had a very poor appearance. The green coke obtained in run E was a spongy one having a lot of foam.

As is clear from Table 3, the cokes obtained by the process of this invention had very high quality.

EXAMPLE II

Decant oils having the properties shown in Table 4 were pretreated under the conditions summarized in Table 5 to obtain a coking feedstock.

TABLE 4

| | |
|---|---|
| Specific gravity, 15°/4° C. | 1.0192 |
| Asphaltenes ($C_7$ insolubles) | 3.7 wt % |
| Conradson carbon | 6.4 wt % |
| Sulfur content | 0.64 wt % |
| Ash | 0.01 wt % |

TABLE 5

| | | |
|---|---|---|
| Soaking | Amount of sulfur added | 50 ppm |
| | Temperature | 270° C. |
| | Residence time | 15 min |
| Cracking | Tube inner diameter | 6 mm |
| | Outlet temperature | 490° C. |
| | Pressure | 22 kg/cm$^2$G |
| | Residence time | 78 sec |

TABLE 5-continued

| | | |
|---|---|---|
| Flashing | Temperature | 480° C. |
| | Pressure | Atm. |

The material balance in the pretreatment was shown in Table 6.

TABLE 6

| | |
|---|---|
| Pitch | 11.1 wt % |
| Coker feedstock (290° C.$^+$) | 84.3 wt % |
| Distillate (290° C.$^-$) | 2.4 wt % |
| Cracked gas & loss | 2.2 wt % |

Coking was performed on the feedstocks so obtained under the conditions summarized in Table 7, and the VCM content of green coke so derived is also shown in the same table.

TABLE 7

| Run No. | | F | G | H | I |
|---|---|---|---|---|---|
| On-Stream Delayed Coking | Temp. (°C.) | 435 | 440 | 447 | 430 |
| | Press. (kg/cm$^2$G) | 5 | 5 | 5 | 5 |
| | Time (hr) | 24 | 24 | 24 | 24 |
| | Recycle ratio | 0.6 | 0.6 | 0.6 | 0.6 |
| | QI in coke drum | 3 | 3 | 4 | 4 |
| Off-Stream Heating | Temp. (°C.) | 460 | 460 | 447 | 430 |
| | Time (hr) | 6 | 6 | 6 | 6 |
| | Heated vapor | STM | STM | STM | STM |
| Green coke VCM (wt %) | | 6.2 | 5.8 | 11.7 | 23.6 |

Runs F and G were performed by the process of this invention, while run H was performed at a higher on-stream coking temperature than the invention, and run I at a lower off-stream heating temperature, than that of the invention. Electrodes were made from coke obtained under the conditions summarized in Table 7 and graphitized at 3,000° C. The CTE and MR of graphitized electrodes are shown in Table 8.

TABLE 8

| Run No. | F | G | H | I |
|---|---|---|---|---|
| CTE ($\times 10^{-6}$/°C.) in the direction parallel to the extrusion (100–400° C.) | 0.86 | 1.00 | 1.17 | 1.33 |
| MR (%) | 21.6 | 17.5 | 12.9 | 10.3 |

As is clear from Table 8, coke obtained by the process of this invention had a very high quality.

EXAMPLE III

Pyrolysis tar obtained as a by-product in the thermal cracking of gas oil was pretreated under the conditions summarized in Table 9 and coke made from the coking feedstock so refined.

TABLE 9

| | | |
|---|---|---|
| Soaking | Amount of sulfur added | 100 ppm |
| | Temperature | 260° C. |
| | Residence time | 20 min |
| Cracking | Tube inner diameter | 6 mm |
| | Outlet temperature | 470° C. |
| | Pressure | 25 kg/cm$^2$G |
| | Residence time (based on cold oil) | 62 sec |
| Flashing | Temperature | 460° C. |
| | Pressure | Atm. |

Coking was performed on this coking feedstock under the conditions summarized in Table 10.

TABLE 10

| Run No. | | J | K | L | M |
|---|---|---|---|---|---|
| On-Stream Delayed Coking | Temp. (°C.) | 435 | 460 | 440 | 445 |
| | Pressure (kg/cm$^2$G) | 6.5 | 6.5 | 6.5 | 6.5 |
| | Time (hr) | 24 | 24 | 24 | 24 |
| | Recycle ratio | 1.0 | 1.0 | 1.0 | 1.0 |
| Off-Stream Heating | Temp. (°C.) | 460 | 460 | 460 | 460 |
| | Time (hr) | 8 | 8 | 8 | 8 |
| | Heated vapor | Coker light distillate | None (external) | Light Coker distillate | Light Coker distillate |
| Green Coke VCM (wt. percent) | | 6.7 | 5.4 | 6.3 | 5.7 |

Run J was performed by the process of this invention, whereas run K was performed at a higher on-stream coking temperature than in run J. Electrodes were made from coke in the same way as in Example I, and the CTE of electrodes graphitized at 3,000° C. was measured. The results of measurement are shown in Table 11.

TABLE 11

| Run No. | J | K | L | M |
|---|---|---|---|---|
| CTE ($\times 10^6$/°C.) in the direction parallel to the extrusion (100–400 PC) | 0.73 | 1.38 | 0.87 | 0.99 |

EXAMPLE IV

Hydrodesulfurized decant oil having the properties shown in Table 12 was pretreated under the same conditions as shown in Table 5 of Example II to obtain a coking feedstock.

TABLE 12

| | |
|---|---|
| Specific Gravity, 15/4° C. | 1.0142 |
| Asphaltenes ($C_7$ insolubles) | 0.2 Wt. Percent |
| Conradson Carbon | 2.6 Wt. Percent |
| Sulfur content | 0.52 Wt. Percent |
| Ash | 0.01 Wt. Percent |

Coking was performed on this coking feedstock under the conditions summarized in Table 13, and the VCM content of green coke so derived is also shown in the same table.

TABLE 13

| Run No. | | N | O | P |
|---|---|---|---|---|
| On-Stream Delayed Coking | Temp. (°C.) | 445 | 455 | 465 |
| | Pres. (KG/Cm$^2$G) | 6.5 | 6.5 | 6.5 |
| | TIME (HR) | 24 | 24 | 24 |
| | Recycle Ratio | 1.0 | 1.0 | 1.0 |
| Off-Stream Heating | Temp. (°C.) | 465 | 455 | 465 |
| | TIME (HR) | 6 | 2 | 6 |
| | Heated Vapor | Coker Light Distillate | Steam | Coker Light Distillate |
| Green Coke VCM (PCT) | | 7.8 | 12.5 | 5.2 |

Run N was performed by the process of this invention, while run P was performed at a higher on-stream coking temperature than specified in the invention. Run O was performed at an on-stream coking temperature of 455 Deg.C. and then after the drum was filled, the contents of the drum were purged with non-heated steam for two hours, without the use of a temperature greater than the coking temperature. Electrodes were made from coke obtained under the conditions summarized in Table 13 and graphitized at 3000° C. The CTE values of graphitized electrodes are shown in Table 14.

TABLE 14

| Run No. | N | O | P |
|---|---|---|---|
| CTE in the direction parallel to the extrusion (100 to 400° C.) | 0.83 | 1.22 | 1.19 |

As is clear from Table 14, coke obtained by the process of this invention (Run N) had a very high quality.

The present invention is particularly advantageous in that by employing the combination of delaying coking at a lower temperature than normally used in the art, followed by off-stream heating of the coke drum contents, at a higher temperature to produce a coke with a specified VCM content, the coke thus produced (after calcining and graphitizing) has a lower CTE. If the coke is produced at the lower temperatures, followed by calcination and graphitization (no off-stream heating in the coke drum at controlled temperature to provide a VCM content as hereinabove described, prior to calcination), the CTE of the graphitized coke is higher than that provided in accordance with the invention.

The invention, as hereinabove described, is particularly applicable to the production of needle coke (CTE$< 1.35\times10^{-6}$/°C., measured at 100°–400° C., and also super needle coke CTE$<1.1\times10^{-6}$/°C., measured at 100°–400° C.).

The present invention has particular applicability to the coking of a feedstock which has been pretreated by (1) thermal soaking at 230°–315° C., generally in the presence of sulfur (although in some cases sulfur is not required) to decrease the tendency to deposit coke and/or polymer in subsequent lines or equipment and/or (2) thermal cracking at 450° C. to 595° C. to increase aromaticity and/or (3) separation of non-crystalline substances. Although pretreatment is not required and/or pretreatment by use of only one or two of the pretreatment steps may be employed, in general, the best results (lowest CTE) are achieved by use of the three pretreatment steps in combination with the coking at controlled temperatures, followed by off-stream heating to reduce VCM content.

Numerous modifications and variations of the present invention are possible in light of the above teachings and, therefore, within the scope of the appended claims, the invention may be practised otherwise than as particularly described.

We claim:

1. In a process for the delayed coking of a coking feedstock wherein a coking feedstock is heated in a coking heater and introduced into a coke drum, and, after filling of the coke drum to the desired level, the coke drum is taken off-stream by discontinuing introduction of coking feedstock, the improvement comprising:

operating the coke drum at a temperature of from 415° C. to 455° C. prior to taking the coke drum off-stream; and subsequent to taking the coke drum off-stream, heating the contents of the off-stream coke drum at a temperature which is at least 10° C. greater than the prior coking temperature and which is from 450° C. to 500° C., said heating being effected for a time sufficient to provide a coke having a volatile combustible matter content of at least 4% and no greater than 10%, all by weight.

2. The process of claim 1 wherein the heating temperature is at least 15° C. greater than the prior coking temperature.

3. The process of claim 2 wherein the coking temperature is from 420° C. to 450° C.

4. The process of claim 3 wherein the heating temperature is at least 460° C. and no greater than 480° C.

5. The process of claim 1 wherein the off-stream coke drum is heated by passing a heated non-coking vapor through the contents thereof.

6. The process of claim 5 wherein the coking feedstock is pretreated by heat soaking at a temperature of from 230° C. to 315° C. to polymerize unsaturates in the feedstock.

7. The process of claim 6 wherein said heat soaking is effected in the presence of at least 30 ppm of dissolved sulfur.

8. The process of claim 5 wherein the feedstock is pretreated by heating to effect thermal cracking thereof at a final temperature of from 450° C. to 595° C.

9. The process of claim 7 wherein subsequent to the heat soaking the feedstock is pretreated by heating to effect thermal cracking thereof at a final temperature of from 450° C. to 595° C.

10. The process of claim 9 wherein the heating temperature is at least 15° C. greater than the prior coking temperature.

11. The process of claim 10 wherein the coking temperature is from 420° C. to 450° C.

12. The process of claim 11 wherein the heating temperature is at least 460° C. and no greater than 480° C.

13. A process for producing needle coke from a coking feedstock, comprising:

heat soaking the feedstock at a temperature of from 230° C. to 315° C. to polymerize unsaturates;

heating the heat-soaked feedstock to effect thermal cracking thereof at a final temperature of from 450° C. to 595° C.;

separating non-crystalline substances and heavy components to produce a pitch free feed;

heating pitch free feed in a coking heater and introducing the heated pitch free feed into a coking drum operated at a temperature of from 415° C. to 455° C., taking the coke drum off-stream after filling thereof to a desired level by discontinuing introduction of the pitch free feed; and heating the contents of the off-stream coke drum at a temperature which is at least 10° C. greater than the prior coking temperature and which is from 450° C. to 500° C., said heating being effected for a time sufficient to provide a coke having a volatile combustible matter content of at least 4% and no greater than 10%, all by weight.

14. The process of claim 13 wherein the heating temperature is at least 15° C. greater than the prior coking temperature.

15. The process of claim 14 wherein the coking temperature is from 420° C. to 450° C.

16. The process of claim 15 wherein the heating temperature is at least 460° C. and no greater than 480° C.

17. The process of claim 16 wherein the off-stream coke drum is heated by passing a heating non-coking vapor through the contents thereof.

18. A process for producing needle coke from a feedstock containing at least one member selected from the group consisting of pyrolysis fuel oils, lube oil extracts, hydrodesulfurized lube oil extracts, cataytic cracker decant oils and thermally cracked tars, comprising:

separating non-crystalline substances and heavy components to produce a pitch free feed;

heating pitch free feed in a coking heater and introducing the heated pitch free feed into a coking drum operated at a temperature of from 415° C. to 455° C., taking the coke drum off-stream after filling thereof to a desired level by discontinuing introduction of the pitch free feed; and heating the contents of the off-stream coke drum at a temperature which is at least 10° C. greater than the prior coking temperature and which is from 450° C. to 500° C., said heating being for a time sufficient to provide a coke having a volatile combustible matter content of at least 4% and no greater than 10%, all by weight.

19. The process of claim 18 wherein the heating temperature is at least 15° C. greater than the prior coking temperature.

20. The process of claim 19 wherein the coking temperature is from 420° C. to 450° C.

21. The process of claim 20 wherein the heating temperature is at least 460° C. and no greater than 480° C.

22. The process of claim 21 wherein the off-stream coke drum is heated by passing a heated non-coking vapor through the contents thereof.

23. The process of claim 1 wherein the off-stream coke is heated for a time period of from 4 hours to 24 hours.

24. The process of claim 13 wherein the off-stream coke is heated for a time period of from 4 hours to 24 hours.

25. The process of claim 18 wherein the off-stream coke is heated for a time period of from 4 hours to 24 hours.

* * * * *